US005329339A

United States Patent [19]

Sakamoto et al.

[11] Patent Number: 5,329,339

[45] Date of Patent: Jul. 12, 1994

[54] LASER BEAM PRINTER CAPABLE OF FORMING LINE IMAGES HAVING STABLE IMAGE WIDTH

[75] Inventors: Masashi Sakamoto, Toyohashi; Masaki Takahashi, Tokyo; Keizo Nishiguchi, Toyokawa, all of Japan

[73] Assignee: Minolta Camera Kabushiki Kaisha, Osaka, Japan

[21] Appl. No.: 936,893

[22] Filed: Aug. 27, 1992

[30] Foreign Application Priority Data

Aug. 29, 1991 [JP] Japan ..... 3-218175

[51] Int. Cl.[5] ..... G03G 21/00

[52] U.S. Cl. ..... 355/246; 346/160; 355/208

[58] Field of Search ..... 355/77, 203, 204, 208, 355/245, 246; 118/691; 346/160, 153.1

[56] References Cited

U.S. PATENT DOCUMENTS

| | | | |
|---|---|---|---|
| 3,815,988 | 6/1974 | McVeigh et al. | 355/246 |
| 4,416,535 | 11/1983 | Tottori | 355/246 |
| 4,432,634 | 2/1984 | Tabuchi | 355/246 |
| 4,533,234 | 8/1965 | Watai et al. | 355/246 |
| 4,799,082 | 1/1989 | Suzuki | 355/208 |
| 4,870,460 | 9/1989 | Harada et al. | 355/246 |
| 4,984,022 | 1/1991 | Matsushita et al. | 355/246 |
| 5,099,279 | 3/1992 | Shimizu | 355/208 |
| 5,148,289 | 9/1992 | Nishiyama et al. | 346/160 X |

FOREIGN PATENT DOCUMENTS

| | | | |
|---|---|---|---|
| 0048056 | 3/1985 | Japan | 355/246 |
| 0101563 | 4/1989 | Japan | 355/246 |
| 0101564 | 4/1989 | Japan | 355/246 |

*Primary Examiner*—A. T. Grimley
*Assistant Examiner*—Sandra L. Brasé
*Attorney, Agent, or Firm*—Willian Brinks Hofer Gilson & Lione

[57] ABSTRACT

An image forming apparatus wherein a latent image is electrostatically formed on a surface of a photosensitive member and developed by a developing device. In the above image forming apparatus, the reference line image is formed on the surface of the photosensitive member outside the effective image forming area. The width of the reference line image is detected by a sensor. A developing bias voltage applied to the developing device is controllably changed based on the result of detection by a sensor.

2 Claims, 7 Drawing Sheets

LASER BEAM PRINTER CAPABLE OF FORMING LINE IMAGES HAVING STABLE IMAGE WIDTH

BACKGROUND OF THE INVENTION

1. FIELD OF THE INVENTION

The present invention relates to an image forming apparatus for printing and copying apparatus using electrophotographic processes.

2. DESCRIPTION OF THE RELATED ART

Conventional image forming apparatus for printers and the like control the amount of toner supplied to the developing devices to maintain a constant toner density within the developing material, and adjust the electric charging potential and developing bias voltage so as to maintain image quality, particularly uniform image density. Due to the aforesaid type of image density control, a reference electrostatic latent image pattern is formed outside of the effective image formation region on the surface of the photosensitive drum for the purpose of density detection, said reference latent image pattern is developed to produce a visible toner image of the reference latent image, i.e., a reference density pattern image. The density of the reference density pattern image is detected by means of a density detecting sensor of a reflecting type comprising a photoemitter element and a photoreceptor element, such that the amount of toner supplied to the developing devices can be controlled in accordance with the aforesaid reference density detection.

Conventional methods, however, use only the image density criterium in maintaining uniform image quality, and do not consider image resolution. Conventional methods, therefore, do not resolve the problem that line images, e.g., characters and lines and the like become thinner and thicker due to the effects of photosensitive drum deterioration and the like.

SUMMARY OF THE INVENTION

A main object of the present invention is to provide an image forming apparatus capable of normally forming excellent images.

Another object of the present invention is to provide an image forming apparatus capable of normally forming excellent line images.

A further object of the present invention is to provide an image forming apparatus capable of normally forming line images having stable image width, without being adversely influenced by photosensitive drum deterioration and the like.

These objects of the present invention are achieved by providing an image forming apparatus comprising:

- forming means for electrostatically forming a latent image on a surface of a photosensitive member;
- developing means for developing said electrostatic latent image formed on the surface of a photosensitive member;
- applying means for applying a bias voltage to said developing means;
- first control means for controlling the forming means so as to form a latent reference line image on the surface of the photosensitive member and further controlling the developing means so as to develop said latent reference line image to make a developed reference line image;
- detecting means for detecting a width of said developed reference line image; and
- second control means for controlling said applying means so as to vary the value of the bias voltage applied to the developing means based on the result of detection by said detecting means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
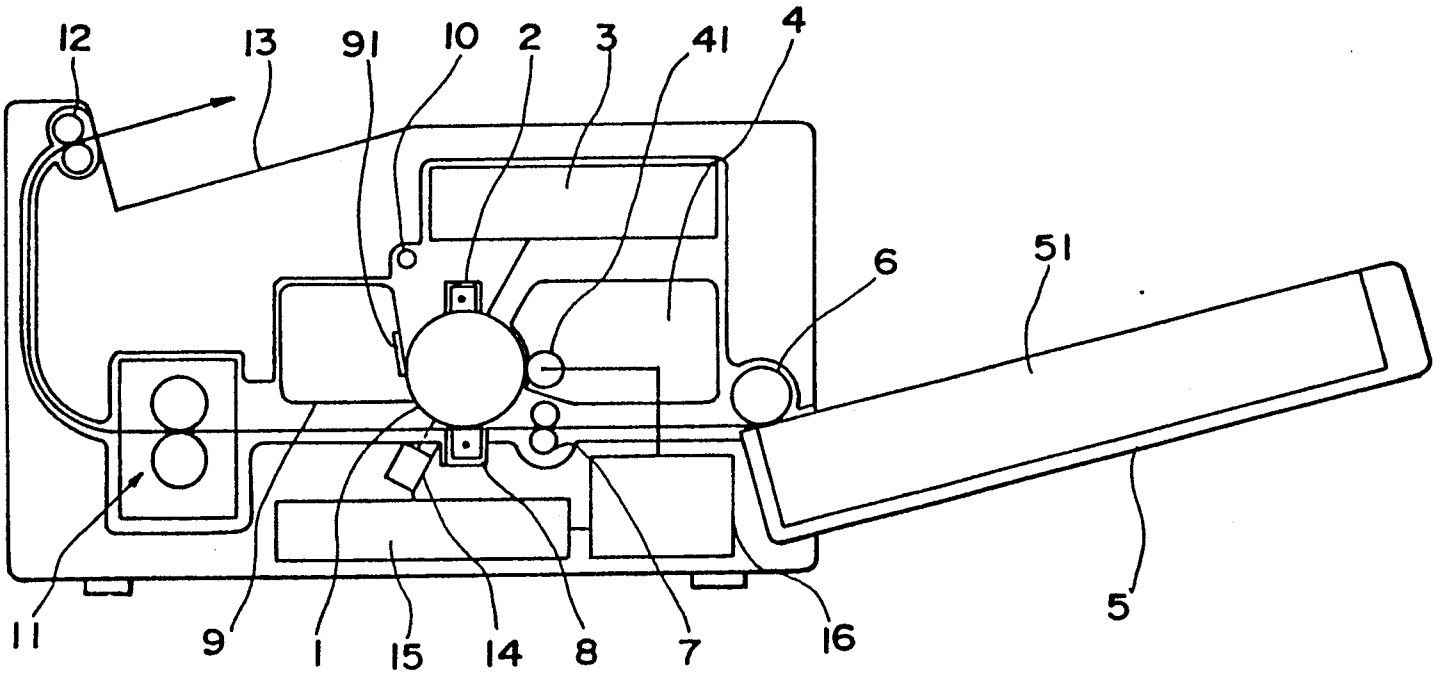
FIG. 1 is a section view showing the general construction of the laser printer of the present invention.

FIG. 1 is a section view showing the general construction of the laser printer of the present invention.

The printer main unit 100 has centrally provided therein a rotatable photosensitive drum 1. Arranged sequentially in the clockwise direction around the periphery of the aforesaid photosensitive drum 1 are print head 3 comprising a laser diode and optical member such as a rotatable polygonal mirror or the like, developing unit 4 of a reverse developing type comprising a developing roller 41, transfer charger 8, cleaning unit 9 comprising a cleaning blade 91, and eraser lamp 10. Provided at the right side in the drawing paper cassette 5 which accommodates the transfer paper sheets 51, and feed roller 6 disposed at the front end of said cassette 5 in the paper feed direction. Sequentially arranged along the paper transport path in the drawing are a timing roller 7, disposed on the right side of the photosensitive drum 1 in the drawing, and fixing roller 11, discharge roller 12, and discharge tray 13, disposed on the left side of said photosensitive drum 1 in the drawing. Furthermore, medially between the transfer charger 8 and cleaning unit 9 are an image width sensor 14 for detecting the image width of a reference line image formed on the surface of the photosensitive drum 1, and disposed at the bottom of the printer main unit 100 are high-voltage power source 16 for supplying a developing bias voltage to the developing roller 41, and a control portion 15 for controlling said printer main unit 100. The high-voltage power source 16 is capable of changing the value of the supplied electrical voltage.

when a print command is issued, the photosensitive drum 1, is electrically charged by the charger 2, and an electrostatic latent image corresponding to the image data is formed on the surface of said drum 1 via the print head 3. The electrostatic latent image is then developed by the developing device 4, and the developed toner image is transferred Via the transfer charger 8 onto a transfer sheet 51 fed from the cassette 5 via the feed roller 6 and synchronized with the photosensitive drum 1 by means of the timing roller 7. The transfer sheet 51 bearing the transferred toner image has said toner image fused thereon by the fixing roller 11, whereupon said transfer sheet 51 is discharged to the discharge tray 13 via the discharge roller 12.

Figure 2:
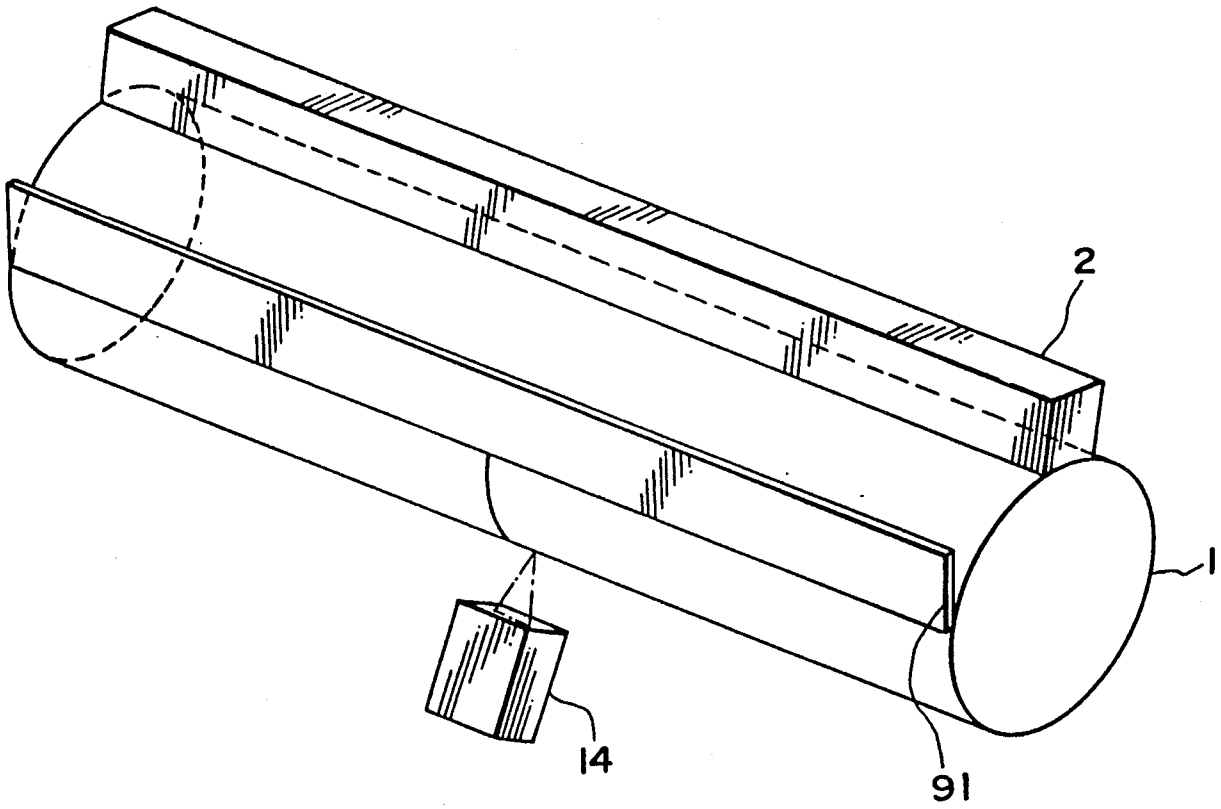
FIG. 2 is a perspective view showing the state wherein the reference line image formed in the sub-scan direction at the center of the surface of the photosensitive drum is detected by the image width sensor.

FIG. 2 shows the state wherein the reference line image formed in the sub-scan direction (direction perpendicular to the axis of the photosensitive drum) at the center of the surface of the photosensitive drum is detected by the image width sensor 14.

The reference line image is a linear reference electrostatic latent image formed on the surface of the photosensitive drum in the sub-scan direction outside the effective image forming area (image interval portion and the like), said latent image being formed by means of a laser beam emitted for a predetermined time period. The width of the reference line image is detected in the main scan direction (direction parallel to the axis of the photosensitive drum) by means of the image width sensor 14. The image width sensor 14 integratedly provides a photoemitter element for irradiating the reference line image with light and a charge-coupled device (CCD) sensor as a photoreceptor element.

The detected image width data are transmitted to the central processing unit (CPU) 405 of the control portion 15 which is described later. In the CPU 405, the detected image width is compared to a reference image width which is determined by a predetermined test or the like and stored in a random access memory (RAM) within the CPU 405. When the detected image width is different than the reference image width, the value of the developing bias voltage supplied to the developing roller 41 is controllably changed in accordance with the aforesaid difference so as to obtain the reference line width. More specifically, in the case of reverse type developing methods as in the present embodiment, when the detected image width is thicker than the reference image width, the developing bias voltage value is reduced, whereas when the detected image width is thinner than the reference image width, the developing bias voltage value is increased.

Figure 4:
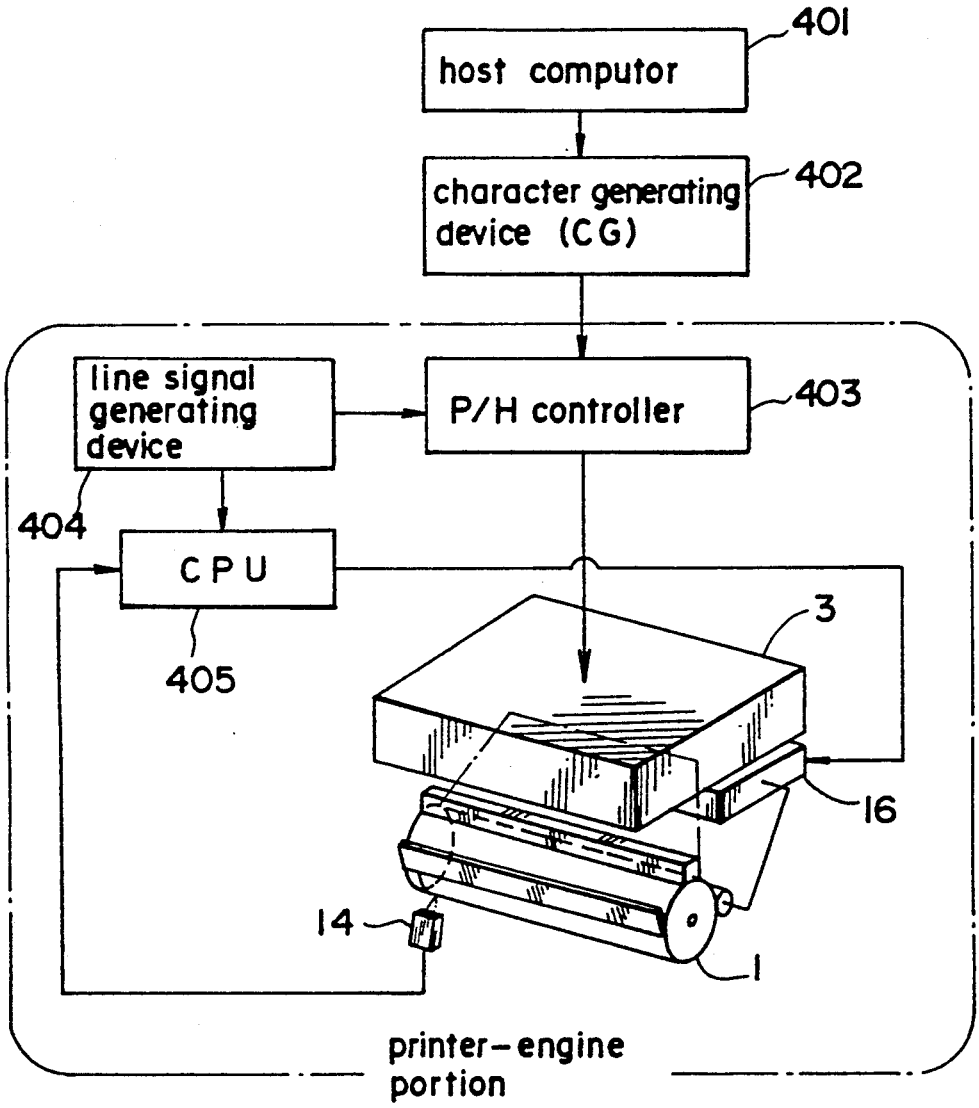
FIG. 4 is a block diagram showing the construction of the control portion.

FIG. 4 is a block diagram showing the construction of the control portion 15.

The image data are input from the host computer 401 to the character generating device 402 where said data are converted to dot patterns, which are then input to the print head controller 403. The print head controller 403 controls the modulation (ON/OFF) of the laser diode based on the aforesaid input image data. On the other hand, the image data used for the line image for forming the reference latent image are also input to the print head controller 403 from the line signal generating device 404. The CPU 405 is connected to the image width sensor 14 and the high-voltage power source 16, and stores the aforementioned image width reference values.

Figure 5:
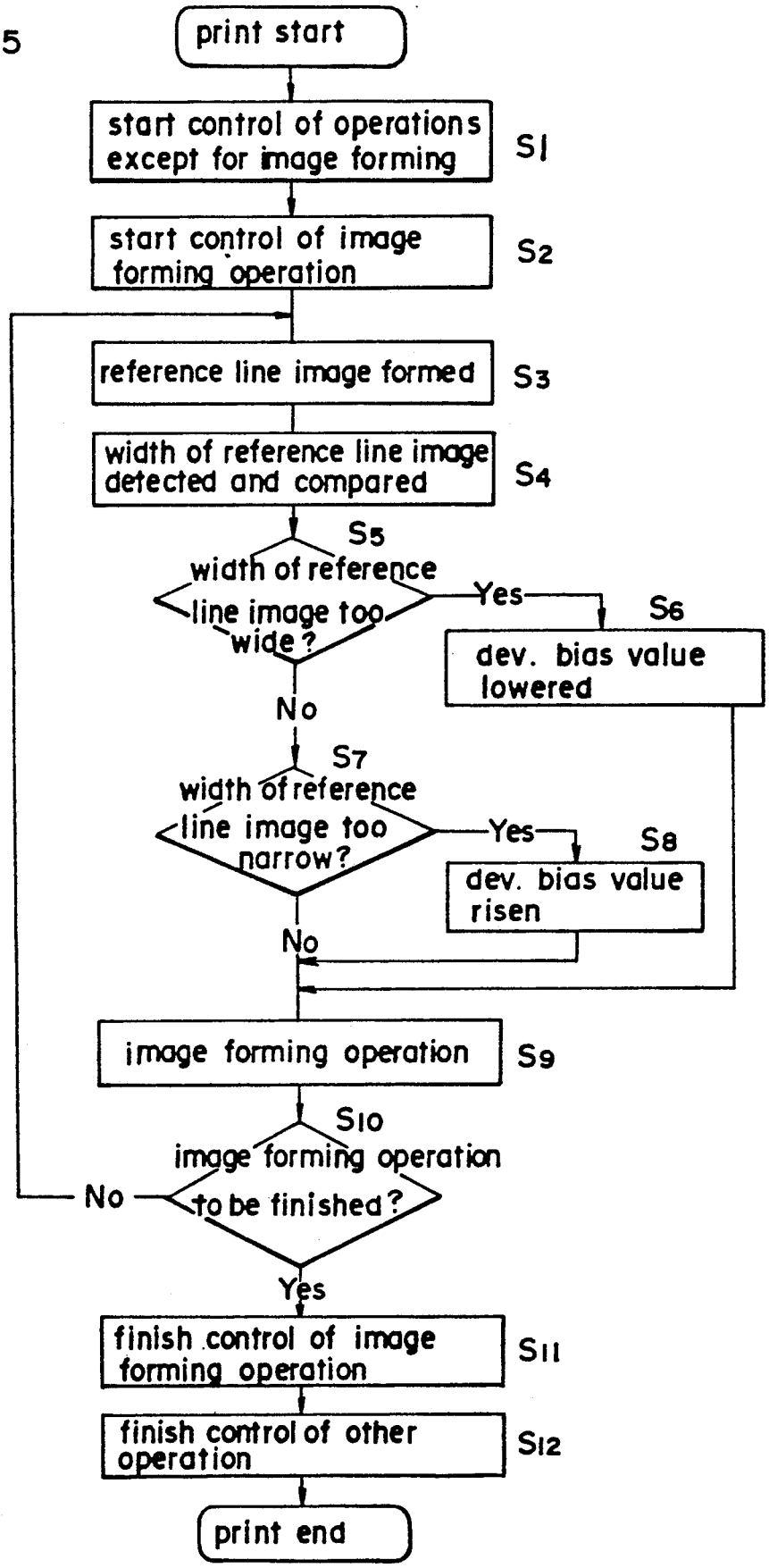
FIG. 5 is a flow chart showing the control sequence in the developing bias control.

FIG. 5 is a flow chart showing the contents of the developing bias voltage control.

When a print start signal is transmitted from the host computer 401 and input to the control portion 15, first, the operation start controls for paper feeding and the like are executed in step S1, then the image forming operation start control is executed in step S2. In step S3, a line image is formed outside the effective image forming area on the surface of the photosensitive drum 1. In step S4, the width of the line image developed by the developing device 4 is detected by the image width sensor 14, and compared to the reference line image width. If the detected image width is determined to be wider than the reference image width (step S5: YES), the routine continues to step S6, and the developing bias voltage is reduced by a voltage value which corresponds to the difference between the detected image width and the reference image width, whereupon the routine continues to step S9. If the detected image width is determined to be narrower than the reference image width (step S7: YES), the routine continues to step S8, and the developing bias voltage is increased by a voltage value which corresponds to the difference between the detected image width and the reference image width, whereupon the routine continues to step S9. In step 9, the image forming operation is executed by the developing bias voltage set in step 6 or step 8, whereupon the routine continues to step 10. In step S10, a check is made to determine whether or not the image forming operation is to be finished. If the image forming operation is not to be finished (step S10: NO), the routine continues to step S3, whereas if the image forming operation is to be finished (step S10: YES), the routine advances to step S11. In step S11, the image forming operation finish control is executed, and the routine advances to step S12 wherein other operation finish controls are executed and printing cycle is completed.

Figure 3:
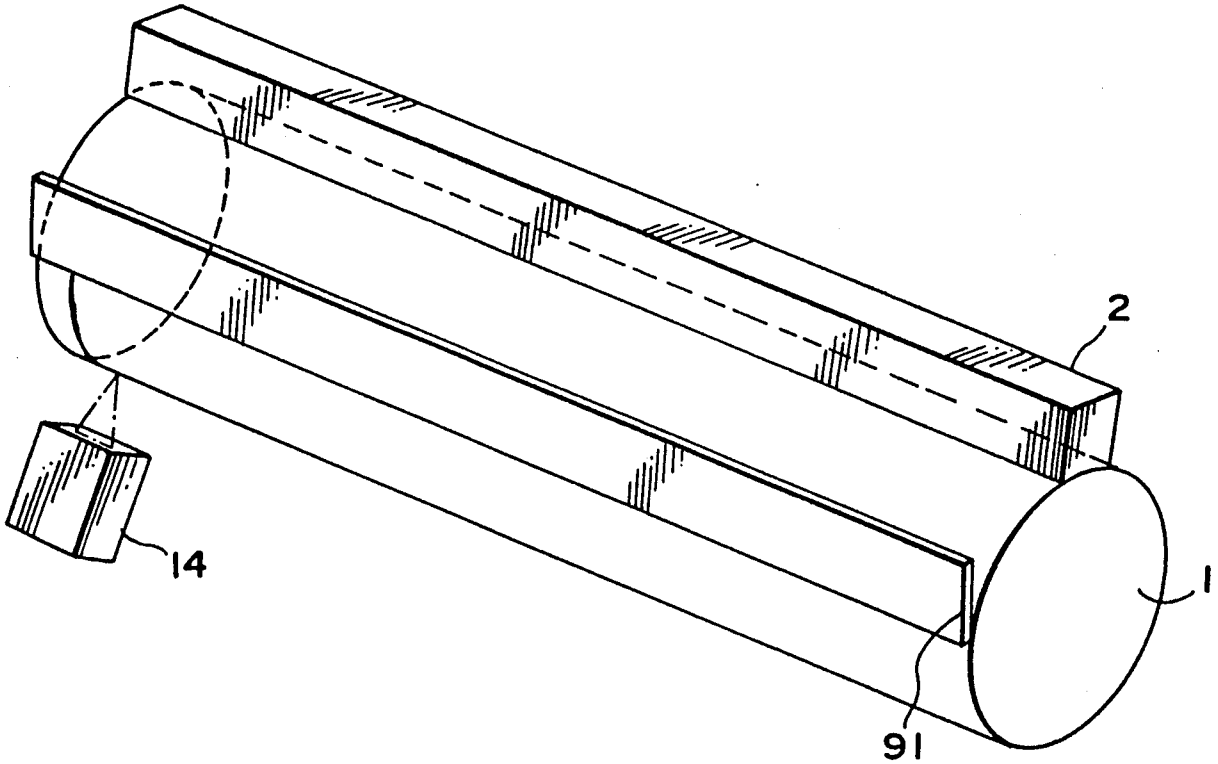
FIG. 3 is a perspective view showing the state wherein the reference line image formed in the sub-scan direction at the edge of the surface of the photosensitive drum is detected by the image width sensor.

Furthermore, the reference line image may be formed at the edge of the photosensitive drum 1 outside the effective image forming area, rather than in the center of said drum 1, such that the image width may be detected by the image width sensor 14 provided at a position opposite said reference latent image, as shown in FIG. 3. When the image width sensor 14 is thus disposed at the edge of the photosensitive drum 1, the image width is adjustable at all times during an image forming operation.

Although, in the aforesaid embodiment, the line image was formed as the reference line image on the surface of the photosensitive drum 1 in the sub-scan direction, it is to be noted that a line image having a predetermined length may be formed as the reference line image in the main scan direction at the center of the surface of the photosensitive drum 1.

Figure 6:
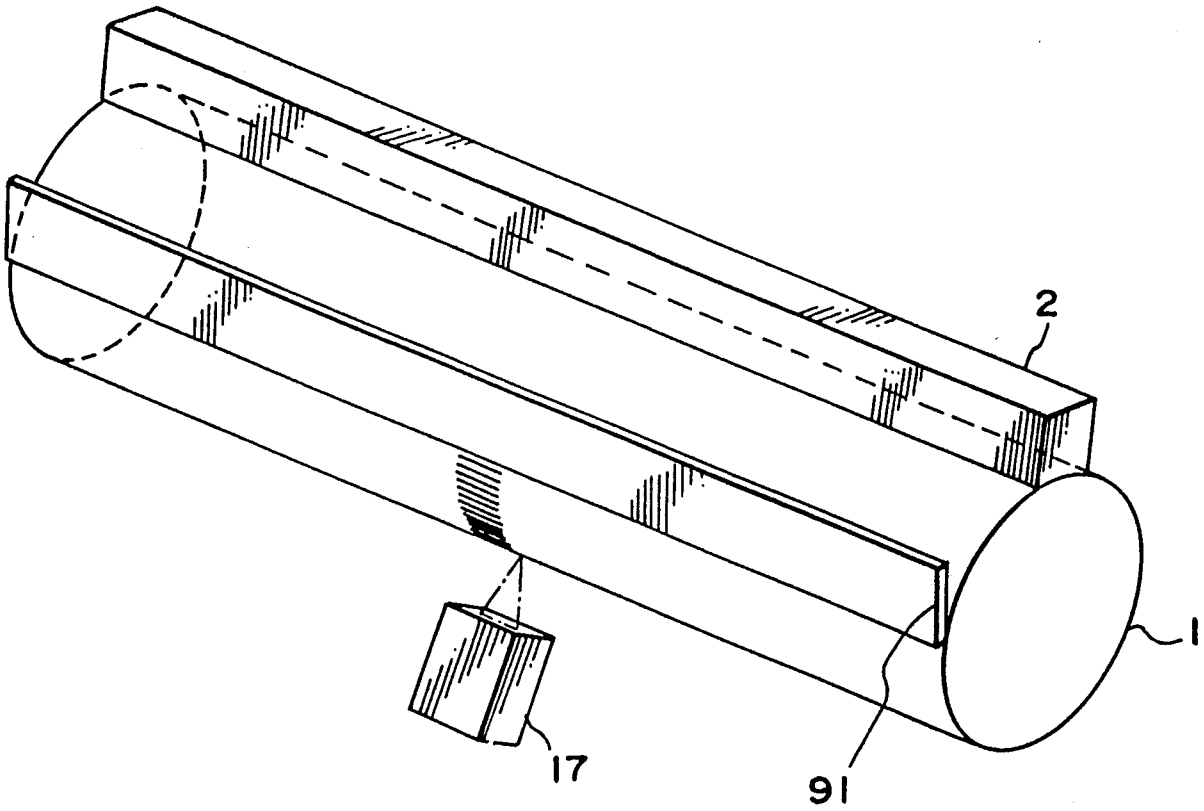
FIG. 6 is a perspective view showing the state wherein a plurality of reference line images formed in the main scan direction at the center of the surface of the photosensitive drum are detected by the image width sensor.

In such a case, the formed reference line image is detected by an image width sensor 17 comprising a photoemitter element, photoreceptor element (CdS) and slit. The photoemitter element and the photoreceptor element confront the photosensitive drum 1 through the slit. The slit has a width narrower than the width of the reference line image formed on the photosensitive drum 1. The time during which the line image passes through the slit is counted to determine the width of the line image. Furthermore, a plurality of line images having predetermined lengths in the main scan direction may be formed in the sub-scan direction (refer to FIG. 6), such that a plurality of image widths can be determined and averaged, to obtain a more accurate line image width.

Figure 7:
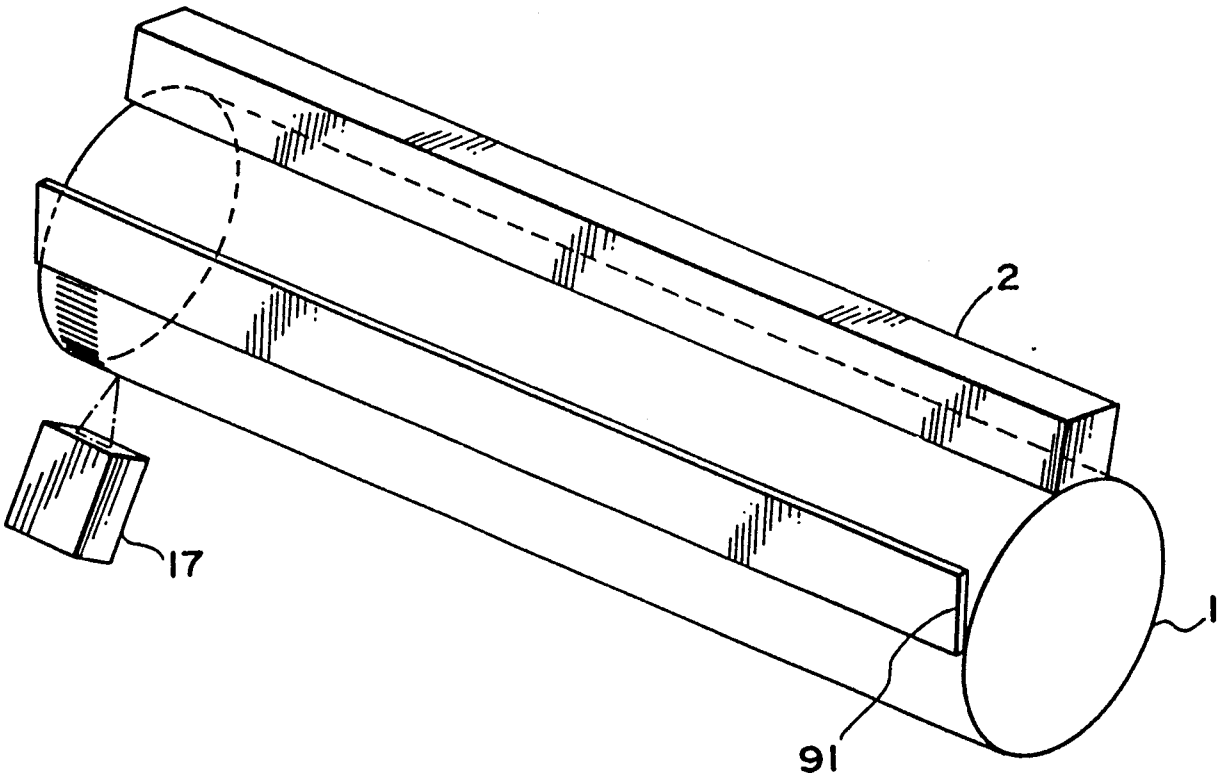
FIG. 7 is a perspective view showing the state wherein a plurality of reference line images formed in the main scan direction at the edge of the surface of the photosensitive drum are detected by the image width sensor.

The aforesaid plurality of line images formed as reference line images need not be formed at the center of the surface of the photosensitive drum 1, but may be formed at the edge of said photosensitive drum 1 outside the image forming area, as shown in FIG. 7.

In addition, the width of the reference line image may be changed in accordance with the type of output characters. For example, if the output characters are a gothic typeface, the width of the reference line image may agree with the character width, whereas if output characters are a Mincho style, the width of the reference line image agree with the width between thick portion and thin portion of the output characters. The character image data and the image data of the reference line image corresponding thereto may be accommodated beforehand and, therefore, when the output characters change, the image data of the reference line image are changed at the same time, such that an optimum developing bias voltage is normally set.

Although, the present invention has been described by way of application in a laser printer, it is to be understood that when applied to copying apparatus, the reference pattern may be provided, for example by forming the reference line image on the document platen.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A laser beam printer comprising:

forming means for electrostatically forming a latent image on a surface of a photosensitive member by a laser beam;

developing means for developing said electrostatic latent image formed on the surface of the photosensitive member;

applying means for applying a bias voltage to said developing means;

control means for controlling the forming means so as to form at least one latent reference line image on the surface of the photosensitive member and further controlling the developing means so as to develop said latent reference line image to make a developed reference line image;

detecting means for detecting a width of said developed reference line image, said detecting means including a photoemitter element, a photoreceptor element and a slit;

counting means for counting the time during which the developed reference line image passes through the slit to determine the width of the developed reference line image;

storing means for storing a reference image width in a memory;

comparing means for comparing the detected image width with the reference image width; and varying means for varying a value of the bias voltage applied to the developing means in accordance with the difference between the reference image width and the detected image width.

2. An image forming apparatus comprising:

forming means for electrostatically forming a latent image on a surface of a photosensitive member;

developing means for developing said electrostatic latent image formed on the surface of the photosensitive member;

applying means for applying a bias voltage to said developing means;

first control means for controlling the forming means so as to form at least one latent reference line image on the surface of the photosensitive member and further controlling the developing means so as to develop said latent reference line image to make a developed reference line image;

detecting means for detecting a width of said developed reference line image, said detecting means including a photoemitter element, a photoreceptor element and a slit;

counting means for counting the time during which the developed reference line image passes through the slit to determine the width of the developed reference line image, and second control means for controlling said applying means so as to vary a value of the bias voltage applied to the developing means based on the result of detection by said detecting means.

* * * * *